US005779112A

United States Patent [19]

Krulik

[11] Patent Number: 5,779,112

[45] Date of Patent: Jul. 14, 1998

[54] BACK PACK WITH SEAT

[75] Inventor: Richard J. Krulik, Hauppauge, N.Y.

[73] Assignee: United States Luggage, L.P., Hauppauge, N.Y.

[21] Appl. No.: 841,253

[22] Filed: Apr. 29, 1997

[51] Int. Cl.[6] ..... A45F 4/02

[52] U.S. Cl. ..... 224/155; 224/653; 224/655; 297/129; 297/43

[58] Field of Search ..... 224/153, 155, 224/627, 645, 650, 653, 654, 655; 297/129, 16.1, 43, 45, 53, 56

[56] References Cited

U.S. PATENT DOCUMENTS

| | | | |
|---|---|---|---|
| 2,375,819 | 5/1945 | Reid | 297/16.1 |
| 2,922,465 | 1/1960 | Johansson | 224/155 |
| 3,266,686 | 8/1966 | Griffith | 224/155 |
| 4,387,924 | 6/1983 | Fernandez | 297/188 |
| 4,676,548 | 6/1987 | Bradbuiry | 224/155 |
| 4,773,574 | 9/1988 | Burgard | 224/155 |
| 5,289,958 | 3/1994 | Jay | 224/155 |
| 5,303,975 | 4/1994 | Asato | 297/129 |
| 5,318,342 | 6/1994 | Hale | 297/129 |
| 5,445,301 | 8/1995 | Biedenharn | 224/155 |
| 5,499,760 | 3/1996 | Pielocik | 224/155 |
| 5,533,654 | 7/1996 | Holty et al. | 224/155 |
| 5,570,829 | 11/1996 | Harrison | 224/155 |
| 5,573,155 | 11/1996 | Sadler | 224/155 |
| 5,588,570 | 12/1996 | Zirbel | 224/155 |

FOREIGN PATENT DOCUMENTS

| | | | |
|---|---|---|---|
| 2825366 | 12/1979 | Germany | 224/155 |
| 1194851 | 6/1970 | United Kingdom | 297/129 |

*Primary Examiner*—Henry T. Recla
*Assistant Examiner*—Gregery M. Vidovich
*Attorney, Agent, or Firm*—Abelman, Frayne & Schwab

[57] ABSTRACT

A backpack provided in combination with a seat unit in which the seat unit may be completely separated from the back pack when it is desired to use the seat unit and when in its storage condition is compactly contained within an auxiliary compartment of the back pack. The seat unit may also be used while it is connected to the back pack, with a portion of the back pack re-positioned to provide a cushion for the seat. The seat unit is formed of a pair of pivoted leg sections, which support a flexible seat, and is secured to a planar support member for the emplacement of the seat unit within the back pack.

18 Claims, 4 Drawing Sheets

FIG. 1
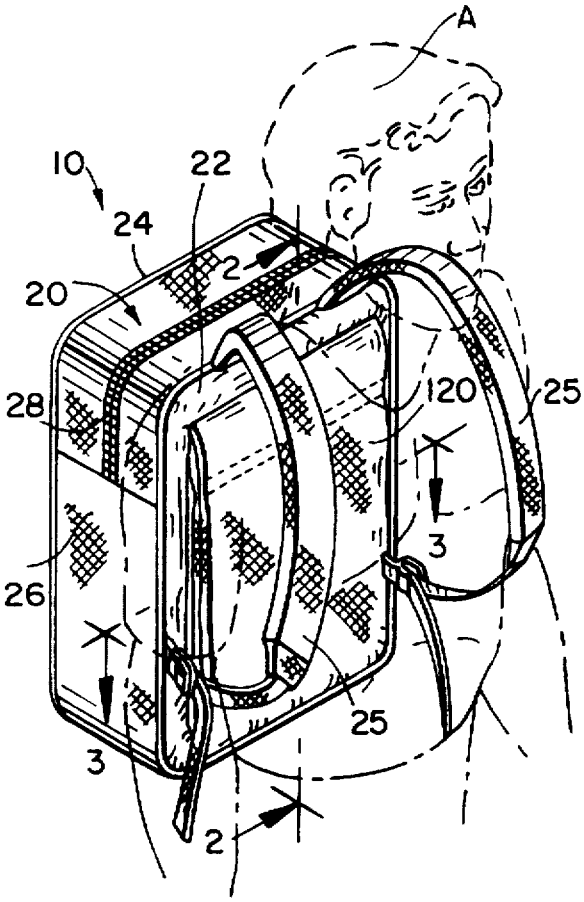
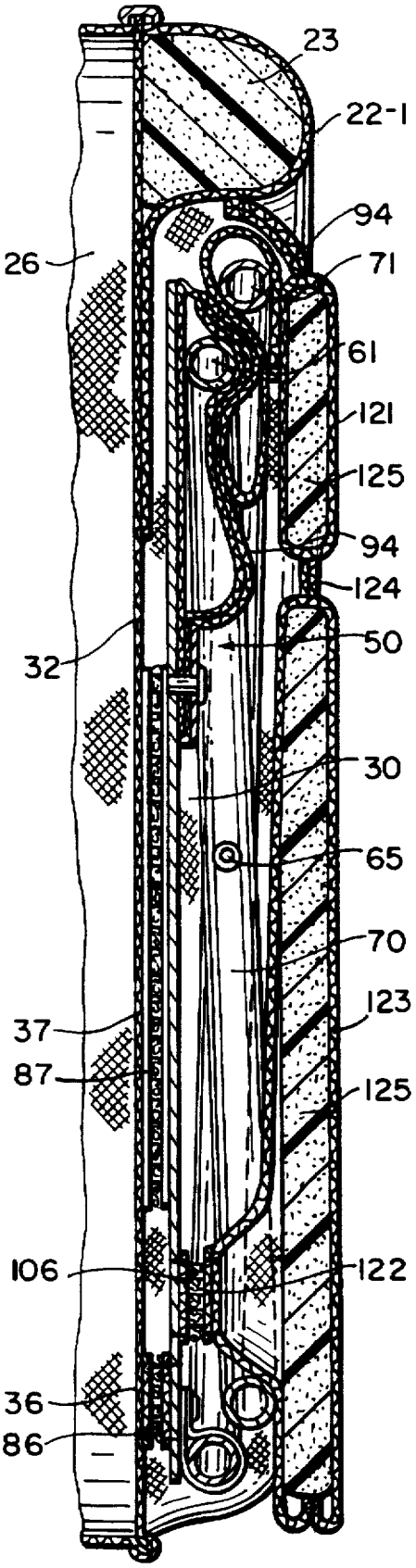
FIG. 2

122
120
123
25
124
20
25
32
121
22-3
d
28
50
38
70
30
36
94
110
l
24
22-2
37
l'
65
108
w'
d'
110
90
100
65
106
60
w 122
120
123
25
124
20
32
25
22-3
121
100
8
80
50
92
108
103
61
94
91
65
90
106
60
95
65
71
24
102
72
103
62
104
70
22-2

BACK PACK WITH SEAT

FIELD OF THE INVENTION

The present invention relates to a combination back pack and seat. If desired, the seat portion may be completed separated from the back pack. The seat portion, when it is in its collapsed condition is releasably inserted within an auxiliary compartment provided within the back pack. When it is desired to utilize the seat, it may be completely removed from the back pack, and its legs pivoted open to provide the requisite seating platform for the user. Alternatively, the seat may remain connected to the back pack with a portion of the back pack moving over the seat to provide cushioning for user comfort.

BACKGROUND OF THE INVENTION

Back packs are commonly used for conveniently carrying a substantial variety of articles intended for numerous daily activities. For example, back packs are typically used to carry books, travel needs or supplies to be used in conjunction with outdoor activities (e.g. hiking, camping, rock climbing, or the like).

Oftentimes the user may wish to temporarily rest at a location that does not include a seat or other appropriate resting spot. Accordingly, it has been recognized that it would be advantageous to provide such a seat in conjunction with the back pack which would readily permit the user to take the back pack off his/her back, open the seat and rest for the desired period of time.

While several such arrangements have been previously proposed to generally provide such a seat in conjunction with the back pack, they have several disadvantages. One such disadvantage, prevalent in numerous of the prior proposals, is the requirement that the seat member be permanently attached to the back pack. This restricts the flexibility of seat utilization, and requires the user to tote the seat portion during those excursions when the user has no intent to utilize the seat. Hence, the user is required to always carry the extra weight and bulk of the seat. Such combination back pack and seats in which the seat sections are permanently connected to the back pack are typically shown in U.S. Pat. Nos. 5,499,760; 5,445,301; 5,533,654; 5,318,342; 5,303,975; 4,773,574 and 4,387,924. Further, the permanent interconnection of the back pack and seat, as typically shown in these prior structures, restricts the matter in which the seat can be used, and, in many instances provides complex and cumbersome arrangements.

Recognizing the desirability of providing increased independence between the back pack and the seat unit, while still permitting easy transporting of the seat unit within the back pack, one aspect of the present invention is to permit seat removal to substantially enhance the versatility and simplification of a combination back pack and seat unit.

Alternatively, should it be desired to maintain the connection of the seat to the back pack, another advantageous feature of the present invention is to reposition a cushioned surface of the back pack to cushion the seat when the seat unit is in its operative condition.

SUMMARY OF THE INVENTION

The present invention provides a combination back pack and seat unit in which the seat unit may advantageously be separated from the back pack. The back pack includes an auxiliary compartment into which the seat unit, which can be compactly collapsed, is inserted and releasably contained therein. Complementary Velcro (hook and loop pressure sensitive fastening elements), or other, attachment members on the seat unit and within the auxiliary compartment may be utilized for retaining the seat unit within the auxiliary compartment. It has been found particularly advantageous to provide the auxiliary compartment along the rear wall of the back pack unit which is intended to lie against the user's back. In that arrangement, a cushioned panel is preferably provided to overlie the seat unit when it is inserted within the auxiliary compartment, so as to avoid any discomfort to the user resulting from the rigid components of the seat unit. This cushioned panel is advantageously constructed to overlie the seating platform of the seat unit should it be desired to utilize the seat unit while it is still connected to the back pack.

Although a variety of seat units may be utilized and appropriately configured to fit within the auxiliary compartment, the present invention shows a particularly advantageous seat unit. The seat unit is formed of a pair of tubular rectangular leg members which are pivotally connected at their mid sections. A flexible seat is connected to the upper ends of the leg members. The leg members can be moved between a first operative condition and a second storage position.

The first operative position is characterized with the leg members being pivotally opened to separate their upper and lower ends in respective spaced horizontal relationship, with the flexible seat spanning and being maintained taut, between the upper ends of the legs, and the separated lower ends of the legs adapted to engage the ground, or other support, surface.

The second storage condition is characterized with the leg members being pivoted closed to a nested flat condition, with the leg members lying substantially in the same plane, and the flexible seat being loosely contained in that plane, such that the entire seat unit is compactly folded into a planar assembly. The seat unit, when in its collapsed condition is sized to snugly fit within the auxiliary compartment of the back pack.

Accordingly, it should be appreciated that when it is desired to utilize the seat, the back pack is taken off the user's back, the cushioned panel is opened to reveal the seat unit, which will be in it collapsed condition. The seat unit may then be removed from the auxiliary compartment, and thereafter the legs pivotally opened so that the seat will then be in its operative first condition. By completely separating the seat unit from the back pack, substantial versatility is provided as to just where the user may wish to locate the seat, without any constraints being imposed by a permanent association with the back pack. Alternatively, the seat unit may be moved to its operative first condition while it is still connected to the opened auxiliary compartment, with the cushioned panel then overlying the flexible seat.

Further in those situations where the back pack is to be used when the user has no intent of requiring a seat, the seat unit may be removed and left at the user's home or other permanent location, so as not to necessitate the carrying around of the seat unit during those periods of time when there is no intent to use the seat.

Accordingly an object of the present invention is to provide a combination back pack and seat unit, in which the seat unit may be separated from the back pack during its intended utilization.

Another object of the present invention is to provide a combination back pack and separable seat, in which the back pack includes an auxiliary compartment for compactly containing the seat unit when it is in its collapsed, storage condition.

A further object of the present invention is to provide such a combination back pack and separable seat assembly wherein the seat unit may be readily removed from, and reinserted within an auxiliary compartment of the back pack by complementary releasable means contained within the auxiliary compartment and seat unit.

Yet a furter object of the present invention is to provide in conjunction with a combination back pack and seat, a seat unit which is formed of two pivotally connected leg members, having a flexible fabric seat connected to its upper ends, with the fabric seat controlling the degree of pivotal movement between the leg members.

These as well as other objects of the present invention will become apparent upon a review of the following drawings and detailed descriptions.

BRIEF DESCRIPTION OF THE DRAWINGS

FIG. 1 is a perspective view showing the manner in which the combination back pack and the seat unit, in its fully assembled condition, is carried by the user.

FIG. 2 is a cross-sectional view along the line 2—2, as shown in FIG. 1, and looking in the direction of the arrows.

Figure 3:
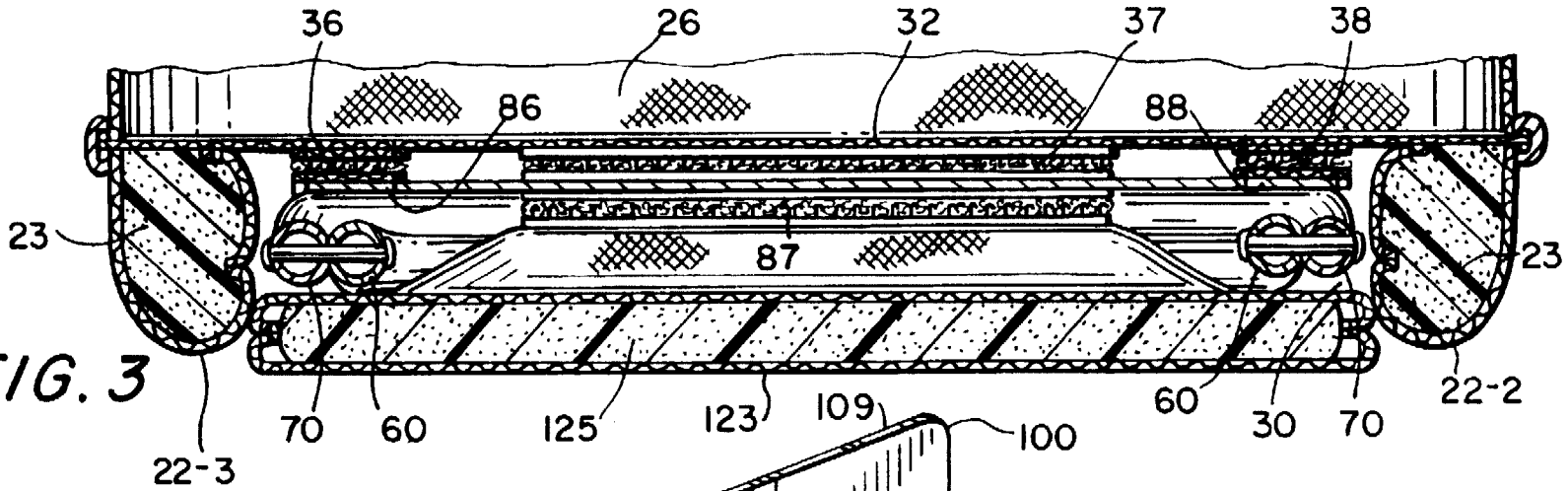
FIG. 3 is a cross-sectional view along the line 3—3 as shown in FIG. 1 and looking in the direction of the arrows.

Reference is initially made to FIG. 1 which shows the combination back pack and separable seat assembly 10 carried on the back of the user, A, shown in phantom lines. The back pack unit 20 includes a rear wall 22, front wall 24, which define therebetween an article receiving department 26. A manually openable means 28 which may typically be a zipper, provides access to the article receiving compartment 26, as well as closing thereof. Conventional shoulder straps 25 extend outward of the rear wall 22 for positioning and maintaining the back pack unit 20 against the user's back. Back pack unit 20 may be formed of a reenforced fabric material such as canvas. It should however be appreciated that alternative materials may be utilized according to the overall requirements of the specific unit.

Figure 4:
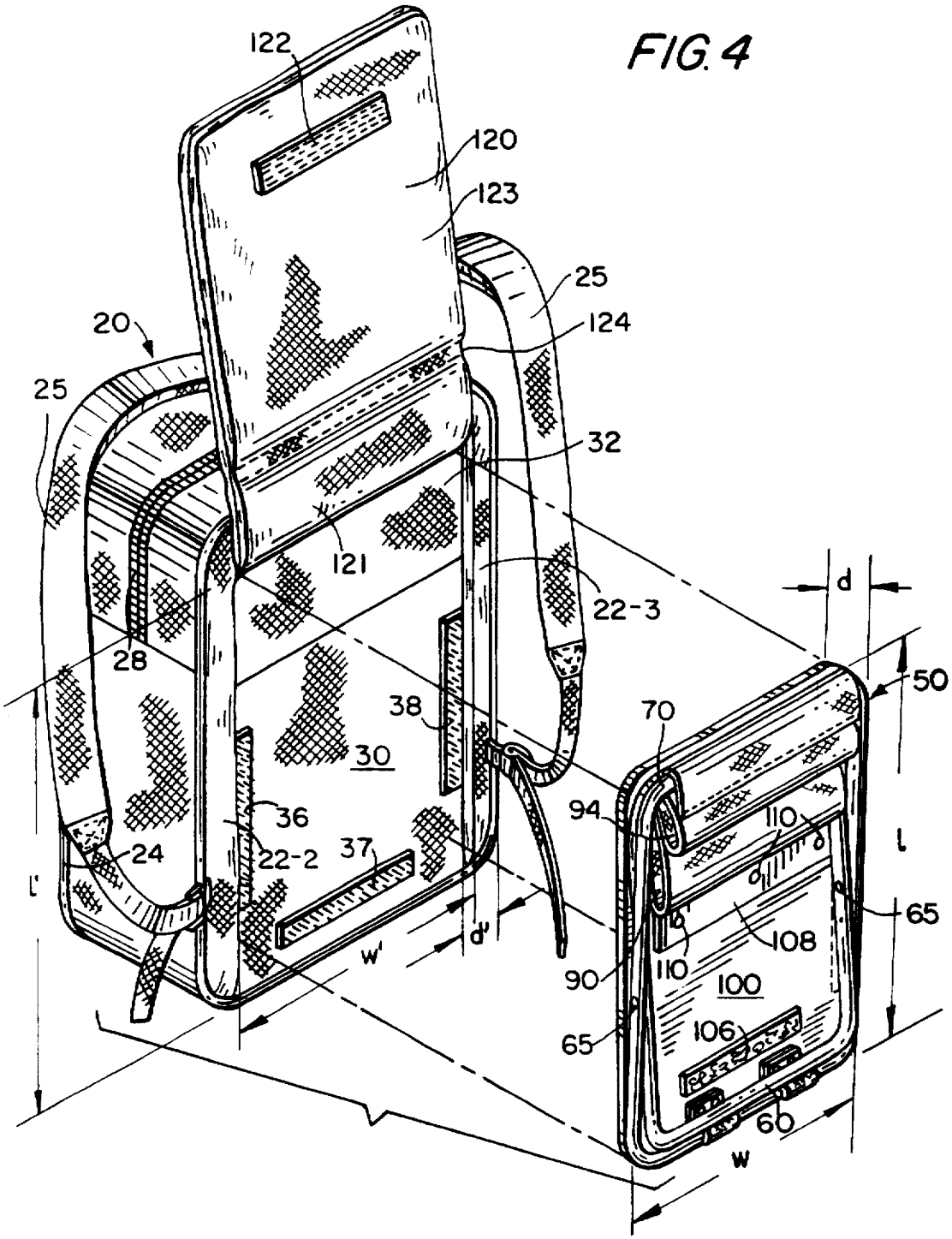
FIG. 4 is an exploded perspective view showing the manner in which the seat unit, when it is in storage condition, is intended to be placed within the auxiliary compartment of the back pack unit.

Referring now additionally to FIGS. 2–4, the rear wall 22, includes side segments 22-2 and 22-3 and upper segment 22-1, to provide an auxiliary compartment 30 therebetween. The auxiliary compartment spans a substantial portion of the length and width of the rear wall. The auxiliary compartment is recessed from the rear most extent of the back pack by an amount d' (see FIG. 4) towards the front wall by a depth which is substantially less than the depth of the article receiving compartment 26. A separator wall 32 at the recessed inward extent of the auxiliary compartment 30 separates the auxiliary compartment 30 from the article receiving compartment 26.

Figure 6:
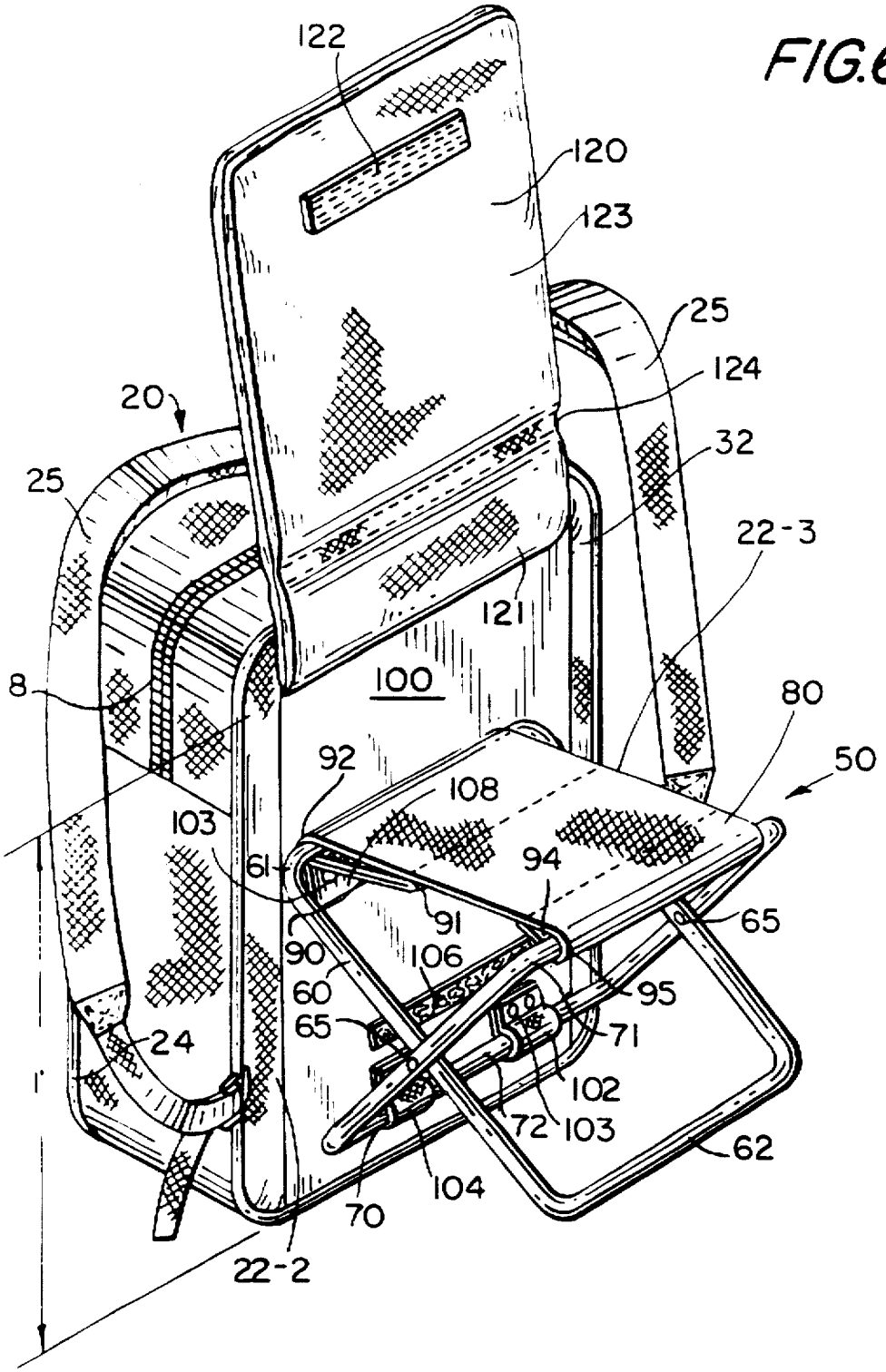
FIG. 6 is a perspective view showing the seat unit in its first operative position while it is still connected to the auxiliary compartment.

The auxiliary compartment 30 includes spaced releasable means (36, 37, 38) which may be Velcro members, for a purpose which will subsequently be explained in conjunction with the containment within the auxiliary compartment 30 of the seat unit assembly 50. In order to provide access to and coverage of the auxiliary compartment 30, a cushioned panel 120 is shown pivotally connected to the upper portion of the back wall. The cushioned panel 120 may preferably include separate sections 121, 123, which are connected at 124, in order to facilitate the cushioned panel overlying the seating platform of the seat unit when the seat unit is opened while it is still connected to the auxiliary compartment, as shown in FIG. 6.

Panel 120 includes cushioning material 125, which may typically be foam. Similarly the rear wall segments 22-1, 22-2, 22-3 include foam cushioning material 23. It should be readily appreciated that other cushioning materials may be utilized. The panel 120 also includes a releasable closure strip 122 for retaining same in the closed position, as will subsequently be explained.

Figure 5:
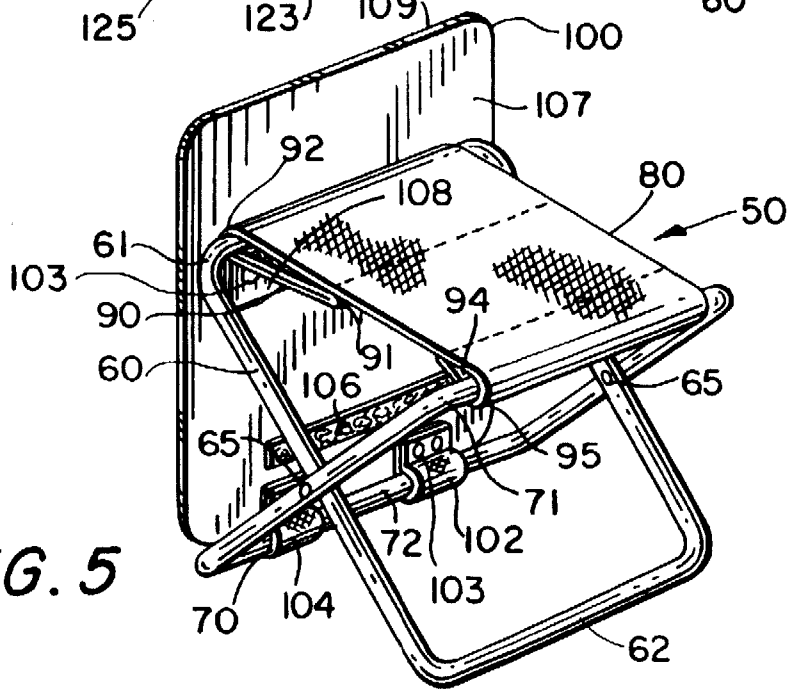
FIG. 5 is a perspective view showing the seat unit, separated from the back pack unit, and in its operative seating condition.

Referring to additional FIG. 5, the seat unit 50 is formed of three principal members. They are, tubular rectangularly shaped, and pivotally connected, legs 60, 70 and flexible seat 80. Additionally, the seat assembly is preferably connected to a planar storage support member 100 which, as will be subsequently discussed, is configured in association with the auxiliary compartment 30 for retaining the seat unit 50 within storage compartment 30.

The legs 60 and 70 include upper arms, or bite portions 61, 71 and opposed lower legs 62, 72. Legs 60, 70 are pivoted together at their midsection 65 so as to move between the operative condition shown in FIG. 5, and storage condition shown in FIGS. 2–4. The seat section 80 includes opposed downward ends which form pockets 90, 94 for containing the upper leg bite portions 61, 71. Pocket 90 is significantly longer than pocket 94. When the seat is in the storage position, such that the legs 60, 70 are in a nested coplanar condition (see FIG. 4) the leg bite portion 61 will be located against pocket end 91. Conversely when the seat unit 50 is removed from the auxiliary compartment 30 and moved to the operative condition, the upper leg bite portion 61 will bear against end 92 of the pocket 90 (FIG. 5). Hence, the extent of pocket 90 controls the degree to which legs 60, 70 may pivot with respect to each other. In this condition, upper leg bite portion 71 will bear against end 95 of pocket 94.

A planar storage member 100, which may typically be formed of reinforced cardboard, is preferably connected to the seat unit as follows: leg section 72 is connected to one end of planar member 100 by fabric loops 102, 104 with rivet fasteners 103. A portion of the seat unit 80 extending beyond end 92 of pocket 90 is similarly connected to planar member 100 with rivet fasteners 103. Accordingly, when the seat unit is in its collapsed condition (see FIG. 4) the legs 60, 70 and seat section 80 will be in generally coplanar relationship against surface 107 of the planar storage support member 100. It should be noted that the length (l) and width (w) of the seat unit, when it is in its storage condition, closely correspond to the length and width of planar member 100. Likewise the length (l') and width (w') of the auxiliary compartment 30 generally corresponds thereto, with the depth (d') of the auxiliary compartment being generally in the order of the depth (d) of the seat unit assembly 50 in its collapsed condition as shown in FIG. 4. In a preferred embodiment, the dimensions of the auxiliary compartment where l'=13 inches, w'=10 inches and d'=1 inch.

Surface 107 of the planar support member 100 includes a releasable closure member 106 which, when the assembly 50 is placed within the auxiliary compartment 30 will generally overlie releasable member 37 of the auxiliary compartment 30. The opposed surface 109 of the planar support member 100 includes releasable member 86, 87, 88 which will engage releasable members 36, 37 and 38 when the assembly 50 is located within the auxiliary compartment 30. Accordingly when the assembly 50 is placed within the auxiliary compartment 30 the engagement of 36-86, 37-87, 38-88 will retain the seat unit assembly 50 within the auxiliary compartment 30. Further the cushioned panel 120 is then moved downward with engagement of releasable member 122, 106 retaining the panel 120 in its closed condition. The various releasable members (36, 37, 38, 86, 87, 88, 106 and 122) are typically shown as Velcro closures, with one of the complementary members including hooks and the other one including loops. It should however be understood that other types of releasable closure means, such as snaps, might also be employed. Also, the planar supporting member 100 may be deleted aad alternative means provided within the auxiliary compartment (e.g. straps) to maintain the collapsed seat unit therein.

When it is desired to removed the seat unit assembly 50, the engagement of 106-122 is manually defeated, moving the cushioned panel 120 upward, with the seat unit assembly 50 being removed by manually defeating the releasable engagement of 36-86, 37-87 and 38-88. With the seat unit assembly 50 removed from the auxiliary compartment 30, the cushioned panel 120 is then moved downward with the engagement of releasable members 122 and 37 containing the cushioned panel in its closed condition.

Alternatively, as shown in FIG. 6, the seat unit 50 may be opened when cushioned panel is moved upward, and the seat unit 50 utilized while it is connected to the back pack unit 20. The cushioned panel 120 will then be pivoted downward, such that portion 123 covers the flexible seat 80, and portion 121 will cover the area of the auxiliary compartment immediately above the flexible seat 80.

While a preferred embodiment of the present invention has been described in detail, various modifications, alterations and changes may be made without departing from the spirit and scope of the present invention as defmed in the following claims.

I claim:

1. A combination back pack and separable seat, comprising:

a back pack unit including:

front and rear walls to define an article receiving compartment therebetween;

a manually openable means for providing access to said article receiving compartment and closing same;

shoulder straps extending outward of said rear wall adapted for positioning and maintaining the back pack unit against a user's back;

said rear wall including an auxiliary compartment which spans a substantial portion of the width and length of said rear wall, and is recessed from its rearmost extent, towards said front wall by a depth which is substantially less than the depth of said article receiving compartment, such that said auxiliary compartment is externally accessible from said rear wall;

a separator wall at the recessed inward extent of said auxiliary compartment for separating said auxiliary compartment from said article receiving compartment;

a seat unit including:

first and second leg members pivotally connected to each other, each of said leg members including upper and lower ends;

a flexible seat connected to the upper ends of said first and second leg members;

said seat unit manually movable between a first operative condition and a second storage condition;

said first operative condition characterized as said leg members pivoted open to separate both the upper and lower ends of leg members in respective spaced coplanar relationship, with said flexible seat spanning between said separated upper ends, and being maintained in a taut condition, and said separated lower ends adapted to engage a support surface;

said second storage condition characterized as said leg members pivoted closed to a nested flat configuration with both of said leg members, including their upper and lower ends, lying substantially in the same plane, with said flexible seat being adapted to be loosely contained in the same plane, whereby the seat unit is compactly folded into a planar assembly, said planar assembly substantially corresponding to the depth of said auxiliary compartment;

first and second complementary releasable means, said first releasable means within said auxiliary compartment, and said second releasable means carried by said seat unit;

said first and second releasable means maintaining said seat unit in said auxiliary compartment when said seat unit is in said second storage condition, and said first and second releasable means permitting manual removal of said seat unit from said auxiliary compartment, whereby said seat unit may be manually movable to said first operative condition independent of securement to said back pack unit.

2. A combination back pack and separable seat of claim 1, wherein:

each of said leg members rectangularly shaped, and including opposed upper and lower leg sections, and opposed side leg sections, said side leg sections pivotally connected to each other at their mid section;

said upper leg sections connected to opposed ends of said flexible seat, and said lower leg sections adapted to rest on a support surface when said seat unit is in its first operative condition;

said upper leg sections disposed in a generally horizontal plane when said seat unit is in said first operative condition, with the separation between said upper leg sections in said first horizontal plane and the extent of pivotal movement between said side leg sections determined by the expanse of said flexible seat between its opposed ends connected to said upper leg sections; and when said seat unit is in said first operative condition said lower leg sections, disposed in a second generally horizontal plane, vertically displaced downward from said first horizontal plane, with the separation between said lower leg sections within said second horizontal plane generally corresponding to the separation between said upper leg sections in said first horizontal plane.

3. A combination back pack and separable seat of claim 1 wherein:

said seat unit when in said second storage condition forming a generally rectangular volume having a length l, width w and depth d;

said auxiliary compartment having a length l', width w' and recess d', and l', w' and d', generally corresponding to l, w and d, whereby said seat unit, when in said second storage condition is snugly contained within said auxiliary compartment.

4. A combination back pack and separable seat of claim 1, wherein:

said seat first and second releasable means is formed of complementary hook and loop elements, the hook elements carried by one of said auxiliary compartment or seat unit, and the hook elements carried by the other of said auxiliary compartment or seat unit.

5. A combination back pack and separable seat of claim 2, wherein:

said flexible seat including downwardly turned first and second pockets at its opposed ends, the upper leg section of a first of said leg members contained within said first pocket, and the upper leg section of a second of said leg members contained within said second pocket, said second pocket being significantly longer then said first pocket; the longitudinal extent of said second pocket corresponding to the desired movement of the upper leg section of said second leg member, as said seat unit is moved between its first and second conditions, whereby the length of said second pocket controls the extent of pivotal movement from said second storage condition to said first operative condition.

6. A combination back pack and separable seat of claim 2, wherein:

said seat unit further including a rectangularly shaped planar storage support member, having forward and rear surfaces, the forward surface connected, at its opposite ends to the upper leg section of one of said leg members and the lower leg section of the other of said leg members, the area of said planar support storage member closely corresponding to the planar extent of said leg members when pivotally closed to their second storage condition, whereby said leg members and seat unit are compactly folded against said forward surface, when said seat unit is in its storage condition, and said second releasable means is secured to the rear surface of said planar storage support member.

7. A combination back pack and separable seat of claim 6, wherein:

said seat unit when in said second storage condition forming a generally rectangular volume having a length l, width w and depth d;

said auxiliary compartment having a length l', width w' and recess d', and l', w' and d', generally corresponding to l, w and d, whereby said seat unit, when in said second storage condition is snugly contained within said auxiliary compartment; and said planar storage support member is of a size generally corresponding to l' and w'.

8. A combination back pack and separable seat of claim 1, wherein:

said back pack unit further includes a cushioned panel pivotally connected to its rear wall and overlying said auxiliary compartment;

said cushioned panel overlying said seat unit when inserted in said auxiliary compartment in its storage condition, and pivotable open for removal of said seat unit from said auxiliary compartment, whereby said cushioned panel is interposed between said seat unit and the user's back when said seat unit is within said auxiliary compartment and the combination is being transported by a user.

9. A combination back pack and separable seat of claim 8:

further including supplemental releasable means for maintaining said cushioned panel in overlying relationship to said auxiliary panel.

10. A combination back pack and separable seat of claim 9, wherein said supplemental releasable means including a first releasable member on said cushioned panel, a second releasable member in said auxiliary compartment and a third releasable member on said seat unit, said first releasable member engaging said second releasable member when said seat unit is removed from said auxiliary compartment, and said first releasable member engaging said third releasable member when said seat unit is in its storage condition and inserted within said auxiliary compartment.

11. A combination back pack and separable seat of claim 10, wherein:

said seat unit when in said second storage condition forming a generally rectangular volume having a length l, width w and depth d;

said auxiliary compartment having a length l', width w' and recess d', and l', w' and d', generally corresponding to l, w and d, whereby said seat unit, when in said second storage condition is snugly contained within said auxiliary compartment;

said seat unit further including a rectangularly shaped planar storage support member, having forward and rear surfaces, the forward surface connected, at its opposite ends to the upper leg section of one of said leg members and the lower leg section of the other of said leg members, the area of said planar support storage member closely corresponding to the planar extent of said leg members when pivotally closed to their second storage condition, whereby said leg members and seat unit are compactly folded against said forward surface, when said seat unit is in its storage condition;

said second releasable means is secured to the rear surface of said planar storage support member; and said second releasable member is located within said auxiliary compartment and is provided by said first releasable means, and said third releasable member is secured to the forward surface of said planar storage support member.

12. A combination back pack and separable seat of claim 11, wherein all of said releasable means and releasable members are formed of hook and loop elements.

13. A combination back pack and separable seat comprising:

a back pack having front and rear surfaces to define an article receiving compartment therebetween, an openable closure means to provide access to said article receiving compartment, and shoulder straps extending about said rear surface adapted for mounting and maintaining placement of the back pack on a user's back;

said rear surface including an auxiliary compartment, which spans a substantial portion of the width and length of said rear surface, and is recessed towards said front surface, the depth of said recess being substantially less than the depth of said article receiving compartment;

a collapsible seat said auxiliary compartment adapted to releasably receive said collapsible seat;

said collapsible seat including a pair of pivoted legs and a flexible seat, each of said legs formed of rectangularly bent tubular members, having an upper bight portion, lower bight portion and intermediate arms;

said flexible seat including downwardly turned ends to define a first loop forming pocket at a first end of said flexible seat, and a second loop forming pocket at an opposed second end of said flexible seat, said second pocket being significantly longer than said first pocket and including an outer end at said seat second end, and an inward end intermediate the first and second seat ends, and a central foldable portion intermediate said first and second seat ends;

the upper bight portion of a first of said legs located within said first pocket, and the upper bight portion of a second of said legs located within said second pocket;

said legs being pivotally movable between a first operative condition, and a second storage condition;

said first operative condition characterized as said legs being pivotally open with said bight portion of said second leg being at said outer end of said second pocket;

said upper bight portions tensioning said seat to maintain said seat in a generally horizontal taut condition, and said lower bight portions adapted to engage a generally horizontal support surface vertically displaced downward from said flexible seat;

said second storage condition characterized as said legs being pivoted to a nested flat configuration, with one of said upper bight portions, overlying the other upper bight portion, said bight portion of said second leg being at the inward end of said second pocket, and said central foldable portion being collapsed and depending towards said lower bight portions, with said lower bight portions overlying each other, and said first and second legs being in coplanar relationship;

a first releasable means within said auxiliary compartment for maintaining said collapsible seat in the auxiliary compartment when said collapsible seat is in said second storage condition, and complementary second releasable means secured to said collapsible seat for engaging said first releasable means, for storing said collapsible seat in said auxiliary compartment when said collapsible seat is in said second storage condition, whereby:

said first releasable means may be disengaged from said second releasable means to completely remove said collapsed seat from said back pack prior to converting said collapsed seat to its first operative condition.

14. A combination back pack and separable seat of claim 13, wherein:

said collapsible seat when in said second storage condition forming a generally rectangular volume having a length l, width w and depth d;

said auxiliary compartment having a length l', width w' and recess d', and l', w' and d', generally corresponding to l, w and d, whereby said collapsible seat, when in said second storage condition is snugly contained within said auxiliary compartment.

15. A combination back pack and separable seat of claim 14, wherein:

said collapsible seat further including a rectangularly shaped planar storage support member, having forward and rear surfaces, the forward surface connected, at its opposite ends to the upper bight portion of one of said legs and the lower bight portion of the other of said legs, the area of said planar support storage member closely corresponding to the planar extent of said legs when pivotally closed to said second storage condition, whereby said legs and collapsible seat are compactly folded against said forward surface, when said collapsible seat is in said storage condition, and said second releasable means connected to the rear surface of said planar storage support member.

16. A combination back pack and separable seat of claim 14, wherein:

said back pack unit further includes a cushioned panel pivotally connected to its rear wall and overlying said auxiliary compartment;

said cushioned panel overlying said collapsible seat when inserted in said auxiliary compartment in said storage condition, and pivotable open for removal of said collapsible seat from said auxiliary compartment, whereby said cushioned panel is interposed between said collapsible seat and the user's back when the collapsible seat is within said auxiliary compartment and the combination is being transported by a user.

17. A combination back pack and separable seat of claim 14, wherein l' is in the order of 13 inches, w' is in the order of 10 inches and d' is in the order of 1 inch.

18. A combination back pack and seat unit, comprising:

a back pack unit including:

front and rear walls to define an article receiving compartment therebetween;

a manually openable means for providing access to said article receiving compartment and closing same;

shoulder straps extending outward of said rear wall adapted for positioning and maintaining the back pack unit against a user's back;

said rear wall including an auxiliary compartment which spans a substantial portion of the width and length of said rear wall, and is recessed from its rearmost extent, towards said front wall by a depth which is substantially less than the depth of said article receiving compartment, such that said auxiliary compartment is externally accessible from said rear wall;

a separator wall at the recessed inward extent of said auxiliary compartment for separating said auxiliary compartment from said article receiving compartment;

a seat unit including:

first and second leg members pivotally connected to each other, each of said leg members including upper and lower ends;

a flexible seat connected to the upper ends of said first and second leg members; said seat unit manually movable between a first operative condition and a second storage condition;

said first operative condition characterized as said leg members pivoted open to separate both the upper and lower ends of said leg members in respective spaced coplanar relationship, with said flexible seat spanning between said separated upper ends, and being maintained in a taut condition, and said separated lower ends adapted to engage a support surface;

said second storage condition characterized as said leg members pivoted closed to a nested flat configuration with both of said leg members, including their upper and lower ends, lying substantially in the same plane, with said flexible seat being adapted to be loosely contained in the same plane, whereby the seat unit is compactly folded into a planar assembly, said planar assembly substantially corresponding to the depth of said auxiliary compartment;

securing means for maintaining said seat unit in said auxiliary compartment when said seat unit is in said second storage condition, and permitting attachment of said seat unit to said auxiliary compartment when said seat unit is in said first operative condition;

said back pack unit further including a cushioned panel pivotally connected to its rear wall and overlying said auxiliary compartment;

said cushioned panel covering said seat unit when said seat unit is inserted in said auxiliary compartment in its storage condition, and pivotable open for removal of said seat unit from said auxiliary compartment;

said cushioned panel being interposed between said seat unit and the user's back when said seat unit is within said auxiliary compartment and the combination is being transported by a user; and said cushioned panel including a portion adapted to cover said flexible seat when said flexible seat is in its first operative condition and connected to said auxiliary compartment.

* * * * *